US006082579A

United States Patent [19]

Chu

[11] Patent Number: 6,082,579

[45] Date of Patent: Jul. 4, 2000

[54] VENDING MACHINE

[75] Inventor: Byung-Wook Chu, Kwangju, Rep. of Korea

[73] Assignee: Kwangju Electronics Co., Ltd., Rep. of Korea

[21] Appl. No.: 09/085,926

[22] Filed: May 28, 1998

[30] Foreign Application Priority Data

Jul. 29, 1997 [KR] Rep. of Korea ..... 97-35917

[51] Int. Cl.[7] ..... A24F 27/14

[52] U.S. Cl. ..... 221/150 R; 221/92

[58] Field of Search ..... 221/150 R, 150 HC, 221/92, 103, 123, 133, 131, 7, 9; 312/116, 407, 407.1

[56] References Cited

U.S. PATENT DOCUMENTS 4,629,090 12/1986 Harris et al. ..... 221/150 R

*Primary Examiner*—Kenneth W. Noland
*Attorney, Agent, or Firm*—Perman & Green, LLP

[57] ABSTRACT

In order to prevent a defective lock of an upper insulating door caused by its drooping and to improve productivity according to decreases in the number of parts and manufacturing cost, there is provided a vending machine having movable upper and lower insulating doors installed at a main body to be opened to accumulate products on a assembly rack, the vending machine comprising: a lower insulating door disposed with a protruder at a predetermined position for being horizontally swung open; an upper insulating door for being vertically opened by hinges disposed at the both lower parts thereof; a latch lever assembly body disposed at the center of the upper insulating door to control an opening of the upper insulating door; and a stopper assembly body disposed under the latch lever assembly body to support the upper insulating door with a protruder disposed at the lower insulating door when the upper insulating door is vertically swung open at an angle of 90°.

2 Claims, 4 Drawing Sheets

VENDING MACHINE

BACKGROUND OF THE INVENTION

1. Field of the Invention

The present invention relates to a vending machine of no droop at an upper insulation door to thereby prevent a defection closure and to reduce a manufacturing cost with less parts added for improvement of productivity.

2. Description of the Prior Art

In general, a vending machine is a kind of self-service stand. Canned goods, cigarettes, snacks, books and the like are placed and conveniently sold regardless of purchasing time according to consumer demands.

The vending machine is classified into two types, one selling only one kind of products (such as canned product vending machine and cupped goods) and another type selling various kinds of products (for instance, a spiral type of a vending machine).

As shown in FIG. 1, in order to arrange products in a conventional canned product vending machine, a worker opens a door (1) of a main body (2), opens an upper insulating door (40) movably hinged inside the main body (2), folds a standing rack assembly body (20) installed at a lower insulating door (30), puts a box of the products (not shown) on a latch lever assembly body (30), and accumulates products out of the box on an assembly rack (not shown). Accordingly, the standing rack assembly body (20), as shown in FIG. 1, is folded to put the box of products which will be accumulated at the assembly rack.

There are problems in the conventional vending machine, however, in that the weight of the upper insulating door (40) is transmitted to and droop hinges (50 and 60), preventing the latch lever assembly body (30) from being properly locked and the standing rack assembly body (20) is additionally installed to the door (10) increasing the total weight of the product and production cost.

SUMMARY OF THE INVENTION

The present invention is presented to solve the aforementioned problems and it is an object of the present invention to provide a vending machine where an upper insulating door is so installed as to be vertically opened and a stopper assembly body is so disposed at the upper insulating door as to get fixed at a protruder at a lower insulating door for the purpose of placing boxed products thereon, thereby preventing a defective lock of the upper insulating door caused by its drooping and improving productivity according to decreases in the number of parts and manufacturing cost.

In order to achieve the object of the present invention, there is provided a vending machine having movable upper and lower insulating doors installed at a main body to be opened to accumulate products on a assembly rack, the vending machine including:

a lower insulating door disposed with a protruder at a predetermined position for being horizontally swung open;

an upper insulating door for being vertically opened by hinges disposed at the both lower parts thereof;

a latch lever assembly body disposed at the center of the upper insulating door to control an opening of the upper insulating door; and a stopper assembly body disposed under the latch lever assembly body to support the upper insulating door with a protruder disposed at the lower insulating door when the upper insulating door is vertically swung open at an angle of 90°.

BRIEF DESCRIPTION OF THE DRAWINGS

For fuller understanding of the nature and objects of the invention, reference should be made to the following detailed description taken in conjunction with the accompanying drawings in which.

DETAILED DESCRIPTION OF THE INVENTION

Figure 1:
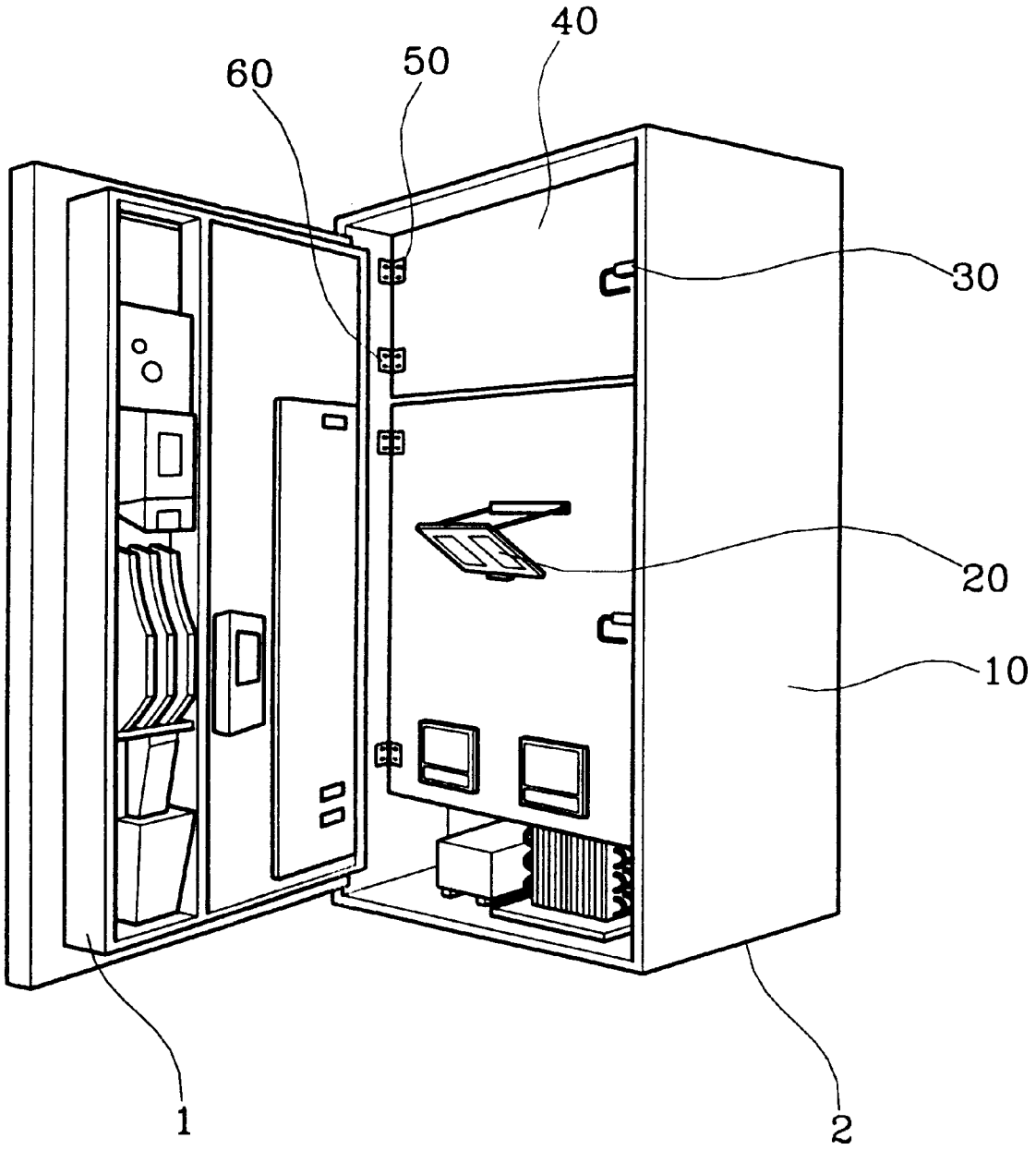
FIG. 1 is a perspective view of a conventional vending machine.
Figure 2:
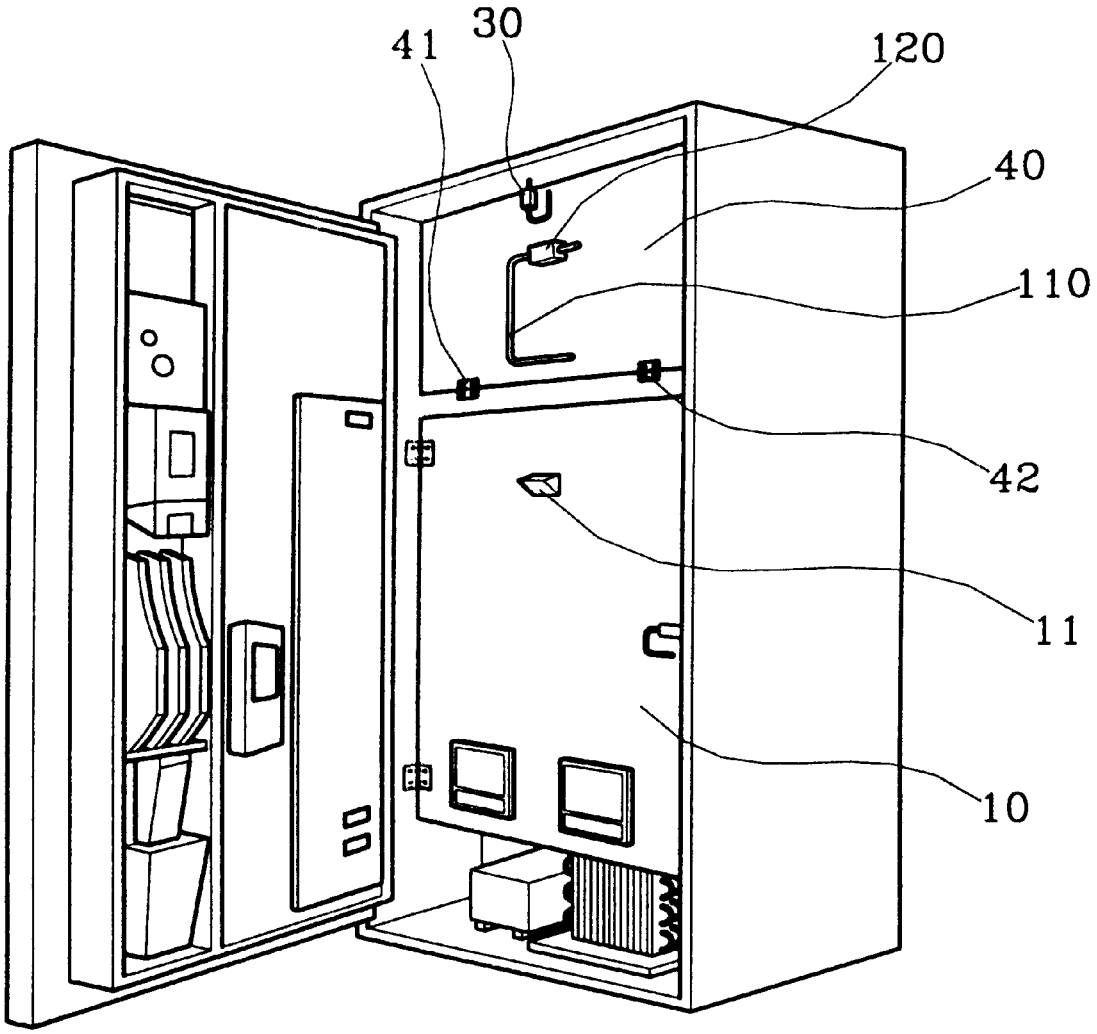
FIG. 2 is a partial perspective view for illustrating a rack part of a vending machine in accordance with the present invention.
Figure 3:
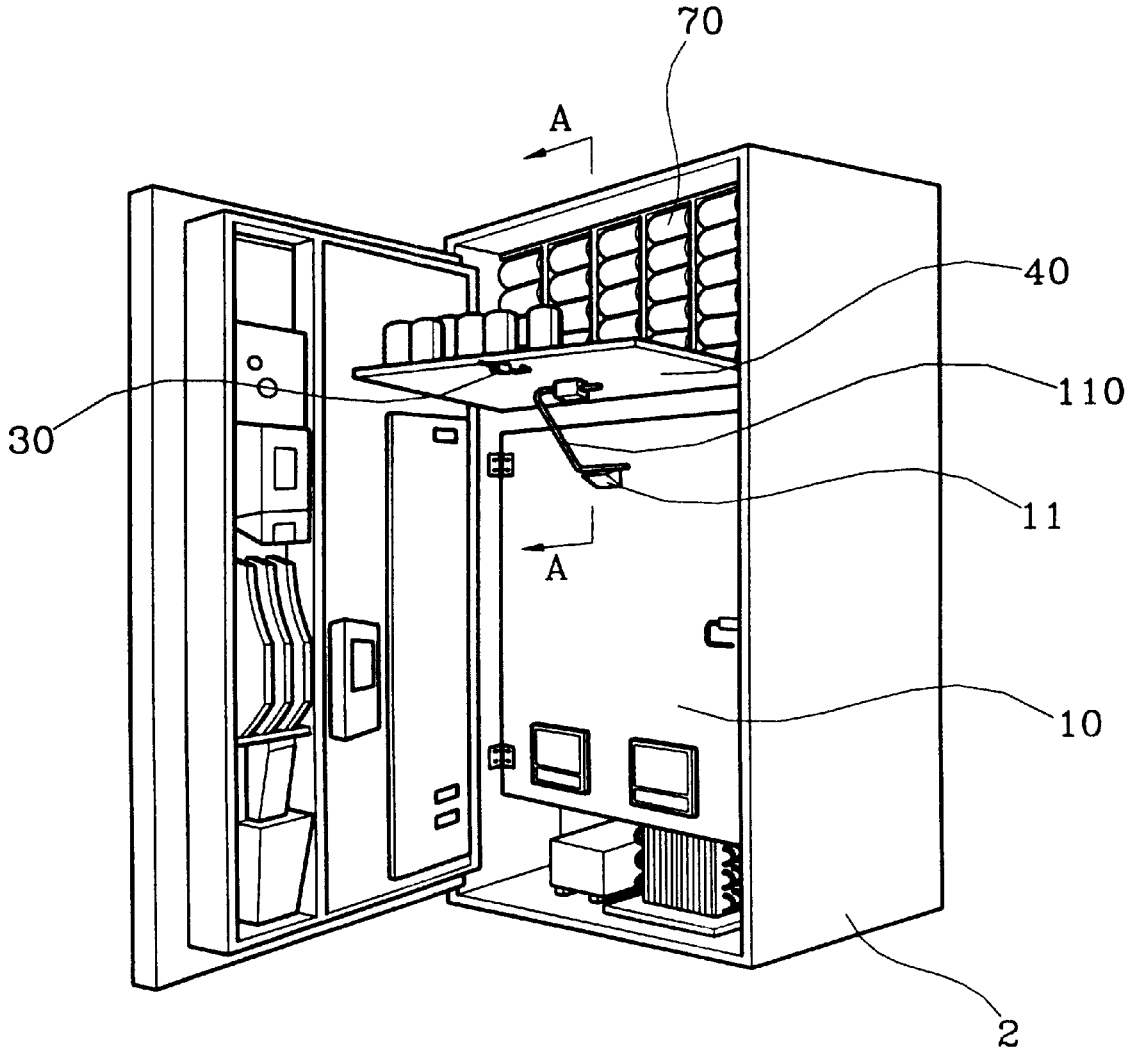
FIG. 3 is a explanatory view for illustrating a state of being a vending machine used in accordance with the present invention.
Figure 4:
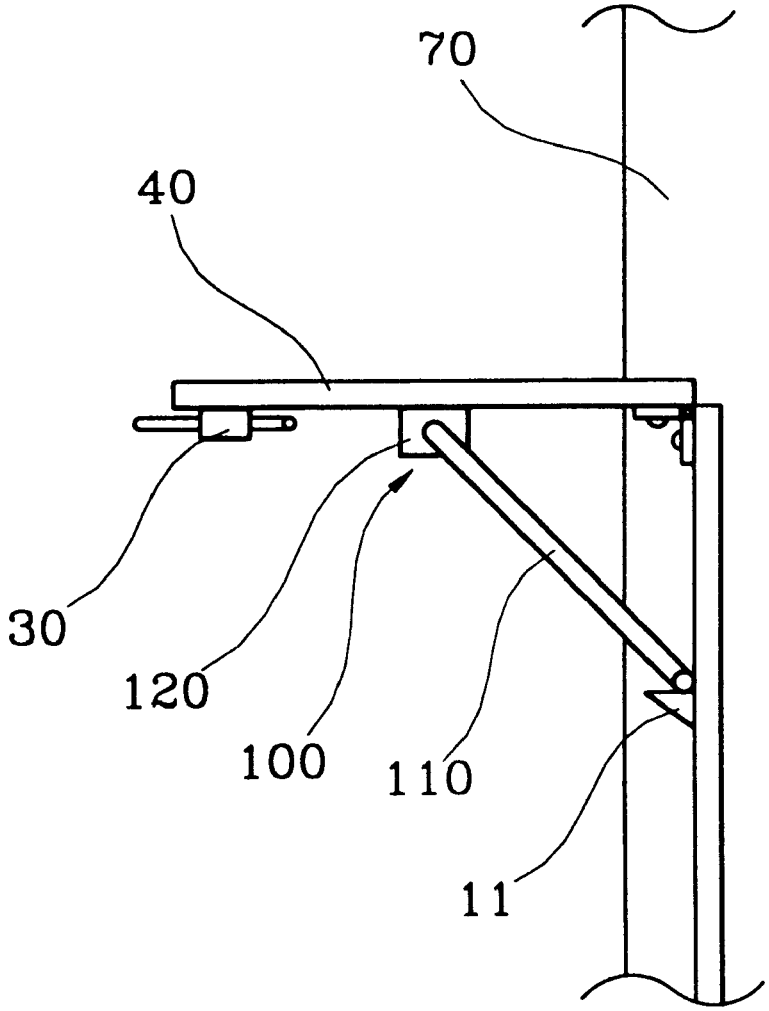
FIG. 4 is a sectional view taken along line A—A in FIG. 3

An embodiment of the present invention is described in detail with reference to the accompanying drawings. In FIGS. 2, 3 and 4, like reference numerals and symbols are used for designation of like or equivalent parts or portions in FIG. 1 for simplicity of illustration and explanation, and redundant references will be omitted.

In the present invention there is provided a vending machine having movable upper and lower insulating doors (40 and 10) installed at a main body (2) to be opened to accumulate products at assembly racks (70) comprising: a lower insulating door (10) to be horizontally swung open including a protruder (11) at a predetermined position; an upper insulating door (40) to be vertically opened by hinges (41 and 42) disposed at the lower parts thereof; a latch lever assembly body (30) at the center of the upper insulating door (40) to control opening of the upper insulating door (40); and a stopper assembly body (100) disposed under the latch lever assembly body (30) to support the upper insulating door with a protruder (11) disposed at the lower insulating door (10) when the upper insulating door (40) is vertically swung open at an angle of 90°.

At this time, the stopper assembly body (100) comprises a ⊏-shaped bent bar (110) to get placed at the protruder (11) and a bracket (120) fixed at the upper insulating door (40) to hinge the bent bar (11) for allowing its rotation.

Next, the operational effect of the present invention is described in detail. As shown in FIGS. 3 and 4, in order to put products in the vending machine, the door (1) is swung open from the main body (2), the latch lever assembly body (30) disposed at the upper insulating door (40) is rotated open from the main body (2) centering the left and right hinges (41 and 42).

At this time, the bent bar (110) of the stopper assembly body (100) installed at the upper insulating door (40) is rotated to get placed at the protruder of the lower insulating door (10) being in parallel to the upper insulating door (40), thereby enabling a number of boxes or products to be placed on the upper insulating door (40). The products are put in the assembly racks.

Therefore, there are advantages of the present invention in that an upper insulating door is installed to be vertically opened and a stopper assembly body is disposed at the upper insulating door to get fixed at a protruder at a lower insulating door for the purpose of placing a number of boxes or products, thereby preventing defective lock of the upper insulating door caused by its bending and improving productivity owing to decrease in the number of parts and manufacturing cost.

Even if an embodiment of the present invention is described here, the actual scope of the present invention is not limited in the presented embodiment. It is believed evident that many variations be made by those skilled in the art without departing from the spirit and scope of this invention.

What is claimed is:

1. A vending machine having movable upper and lower insulating doors installed at a main body to be opened to accumulate products on a assembly rack, the vending machine including:

a lower insulating door disposed with a protruder at a predetermined position for being horizontally swung open;

an upper insulating door for being vertically opened by hinges disposed at the both lower parts thereof;

a latch lever assembly body disposed at the center of the upper insulating door to control an opening of the upper insulating door; and a stopper assembly body disposed under the latch lever assembly body to support the upper insulating door with a protruder disposed at the lower insulating door when the upper insulating door is vertically swung open at an angle of 90°.

2. The vending machine, as defined in claim 1, wherein the stopper assembly rack comprises:

a ⊏-shaped bent bar to get placed at the protruder; and a bracket fixed at the upper insulating door to be hinged to the bent bar for allowing its rotation.

* * * * *